US012139896B2

(12) United States Patent
Huang et al.

(10) Patent No.: US 12,139,896 B2
(45) Date of Patent: Nov. 12, 2024

(54) OUTLET WATER SWITCHING DEVICE WITH TEMPERATURE DISPLAY AND SHOWER SYSTEM

(71) Applicant: Yongqiang Yan, Fujian (CN)

(72) Inventors: Lengjie Huang, Fujian (CN); Pingqing Zhang, Xiamen (CN); Haihua Su, Fujian (CN); Changzheng Ni, Xiamen (CN)

(73) Assignee: Yongqiang Yan, Xiamen (CN)

( * ) Notice: Subject to any disclaimer, the term of this patent is extended or adjusted under 35 U.S.C. 154(b) by 351 days.

(21) Appl. No.: 17/681,585

(22) Filed: Feb. 25, 2022

(65) Prior Publication Data

US 2023/0203795 A1 Jun. 29, 2023

(30) Foreign Application Priority Data

Dec. 29, 2021 (CN) ..... 202111645631.5

(51) Int. Cl.
*E03C 1/04* (2006.01)
*E03C 1/02* (2006.01)

(52) U.S. Cl.
CPC ..... *E03C 1/0408* (2013.01); *E03C 2001/026* (2013.01); *E03C 2001/0418* (2013.01)

(58) Field of Classification Search
CPC ..... E03C 1/0408; E03C 2001/026; E03C 2001/0418
See application file for complete search history.

(56) References Cited

U.S. PATENT DOCUMENTS

2013/0333764 A1* 12/2013 Wright ..... E03C 1/0408 137/551

FOREIGN PATENT DOCUMENTS

CN 210661483 U * 6/2020
CN 113757430 A * 12/2021

* cited by examiner

*Primary Examiner* — Christine J Skubinna

(57) ABSTRACT

The present utility model provides an outlet water switching device with temperature display and a shower system, which are applied to an upward water-feeding shower system. The system includes: a body, wherein the body accommodates an inner body, a valve seat and a water guide chamber in mutual communication are formed on the inner body to dispose a switching valve assembly and a hydraulic power generating device, an inlet water opening and at least one outlet water opening are further disposed on the inner body, the inlet water opening is in communication with the water guide chamber, the outlet water openings are in communication with the valve seat respectively, a water flow impacts the hydraulic power generating device disposed in the water guide chamber to enable the hydraulic power generating device to autonomously generate power.

17 Claims, 9 Drawing Sheets

OUTLET WATER SWITCHING DEVICE WITH TEMPERATURE DISPLAY AND SHOWER SYSTEM

CROSS-REFERENCE TO RELATED APPLICATION

The present application is based on, and claims priority from, Chinese application number CN202111645631.5, filed Dec. 29, 2021, the disclosure of which is hereby incorporated by reference herein in its entirety.

TECHNICAL FIELD

The present disclosure relates to a shower product, and in particular to an outlet water switching device with temperature display and a shower system.

BACKGROUND

Typically, existing shower systems with upward water feeding mainly include a top spray shower head, a sprinkler head and a three-way valve that connects an upper inlet water pipe with the top spray shower head and the sprinkler head, so as to switch to different water delivery states by controlling a knob on the three-way valve. The existing shower systems have limited function, and users cannot know a temperature of an outlet water terminal in time, and may be inconvenient to use.

SUMMARY

To overcome the shortcomings of the prior art, the present disclosure provides an outlet water switching device with temperature display.

To achieve the above objectives, the present disclosure provides the following technical aspects.

There is provided an outlet water switching device with a temperature display, which is applied to a shower system with an upward water feeding. The outlet water switching device includes:

a body, wherein the body includes an inner body, and the inner body comprises a valve seat and a water guide chamber; a switching valve assembly and a hydraulic power generating device are disposed in the inner body to be in mutual communication with the valve seat and the water guide chamber; an inlet water opening and at least one outlet water opening are further disposed on the inner body; the inlet water opening is in communication with the water guide chamber; the outlet water openings are in communication with the valve seat respectively; the hydraulic power generating device is disposed in the water guide chamber to use impact force from a water flow to enable the hydraulic power generating device to autonomously generate power and then the water flow passes through an inlet water hole on a sidewall of the valve seat into the valve seat, and the switching valve assembly selectively opens a water channel between each of the outlet water openings and the inlet water hole;

a display assembly, including a temperature detection element and a display unit disposed at a side of the body, wherein the temperature detection element and the display unit are in electrical connections with the hydraulic power generating device.

In some embodiments, the switching valve assembly includes (a) a water-through body sealingly disposed inside the valve seat and (b) a valve core rod slidably disposed inside the water-through body. A first water hole opposed in position to the inlet water hole and a second water hole in corresponding communication with the outlet water opening are disposed on the water-through body. The valve core rod is enabled to perform reciprocal movement between different positions inside the water-through body under an acting force applied to an end of the valve core rod, so as to selectively open the water channel between the first water hole and each second water hole.

In some embodiments, the outlet water opening includes a first outlet water opening and a second outlet water opening disposed reversely. Two second water holes are correspondingly disposed on the water-through body. The first water hole is located between the two second water holes. A water channel between the first water hole and the second water hole in communication with the first outlet water opening is opened when the valve core rod is located at a first position. A water channel between the first water hole and the second water hole in communication with the second outlet water opening is opened when the valve core rod is located at a second position. The first water hole is blocked when the valve core rod is located at a third position.

In some embodiments, an inlet water mounting portion is further disposed on the body. An inlet water connection rod with adjustable position is fixedly clamped inside the inlet water mounting portion. An end of a self-spin nut is sleeved around an inlet water connection rod and the other end of the self-spin nut is thread-connected to an inlet water support arm.

In some embodiments, an insertion groove is opened at a sidewall of the inlet water mounting portion, an end of the inlet water connection rod is docked with an outlet water opening of the inlet water support arm, a plurality of annular fitting grooves sequentially arranged in a spacing are disposed on an outer wall of the other end of the inlet water connection rod, and a fitting ring is inserted into the insertion groove and fitted with the annular fitting groove.

According to another aspect of the present disclosure, there is provided a shower system. The shower system includes the outlet water switching device with a temperature display as described above, and further includes: (a) a water spray shower head and (b) a pipe communicating the water spray shower head with one of the outlet water openings. The pipe includes a water conveying pipe connected between the water spray shower head and the corresponding outlet water opening and an adjusting pipe sleeved around the water conveying pipe. The water conveying pipe is configured to move up and down or can be rotatable left and right relative to the adjusting pipe.

In some embodiments, a first end of the adjusting pipe is sealingly connected with a corresponding outlet water opening, and a second end of the adjusting pipe is provided with an external thread. A tightening ring with a gap adjustable in size is sleeved inside the second end corresponding to the external thread. An adjustable nut is sleeved around the second end. When the adjustable nut is screwed down with the external thread, the tightening ring embraces the water conveying pipe to fix the water conveying pipe; and when the adjustable nut is loosened, the tightening ring releases the water conveying pipe so as to adjust a height of the water conveying pipe up and down.

According to another aspect of the present disclosure, there is provided a shower system. The shower system includes the outlet water switching device with temperature display as described above, and further includes (1) a sprinkler head, (2) a pipe communicating the sprinkler head with one of the outlet water openings and (3) a fixing seat for fixing the sprinkler head.

In some embodiments, the fixing seat has a rotary head capable of rotating in multiple directions and a first magnetic surface disposed on the rotary head. A second magnetic surface which is opposite in magnetism to the first magnetic surface and capable of being attracted to the first magnetic surface is disposed on the sprinkler head. The fixing seat is mounted on the pipe communicating the sprinkler head with the outlet water opening or a wall surface.

In some embodiments, the pipe communicating the sprinkler head with one of the outlet water openings includes a connection pipe and a water conveying hose. The connection pipe is connected between the outlet water opening and the water conveying hose and rotatable left and right relative to the outlet water opening. A sprinkler head insertion seat rotatable up and down relative to the connection pipe is disposed on a sidewall of the connection pipe. The present disclosure has the following beneficial features.

The present disclosure has at least one of the following beneficial features: 1. A miniature hydraulic power generator is disposed in the water guide chamber to use impact force from the water flow to generate power, so as to achieve real time detection and display of temperature without disposing an additional power source, thus eliminating concerns for circuit wiring, waterproof sealing and electric leakage prevention, etc. and realizing energy waving, environmental protection and increased safety. 2. due to a large distance between the top water delivery three-way valve and the ground, a user with a short height will have difficulty in operating the valve and may easily make mistakes; With the use of a button type water channel switching, the mistakes resulting from unclear current water delivery state level can be avoided, making the design more intuitive. 3. the existing top spray height for an existing shower system cannot be freely adjusted, which is disadvantageous for a user with a tall height and may splash water around for the user with the short height. In the present disclosure, the pipe communicating with the top spray shower head may be freely adjusted by rotating the adjustable nut to deliver top spray at upper and lower water delivery heights and different left and right angles, meeting requirements of the users with different heights. 4. Three ways are adopted to fix the handheld sprinkler head, where the sprinkler head insertion seat is moved down to be fixed together with the integrated set, such that the insertion seat can be rotated up and down or left and right at different angles, meeting habits of different users, especially children. The sprinkler head can be moved down to a proper height to serve as a top spray shower head, bringing more convenience to user; further, the sprinkler head may also be fixed by magnetic attraction force and may be adjusted for angle universally to meet needs of different water delivery angles.

BRIEF DESCRIPTIONS OF THE DRAWINGS

DETAILED DESCRIPTIONS OF EMBODIMENTS

Figure 1:
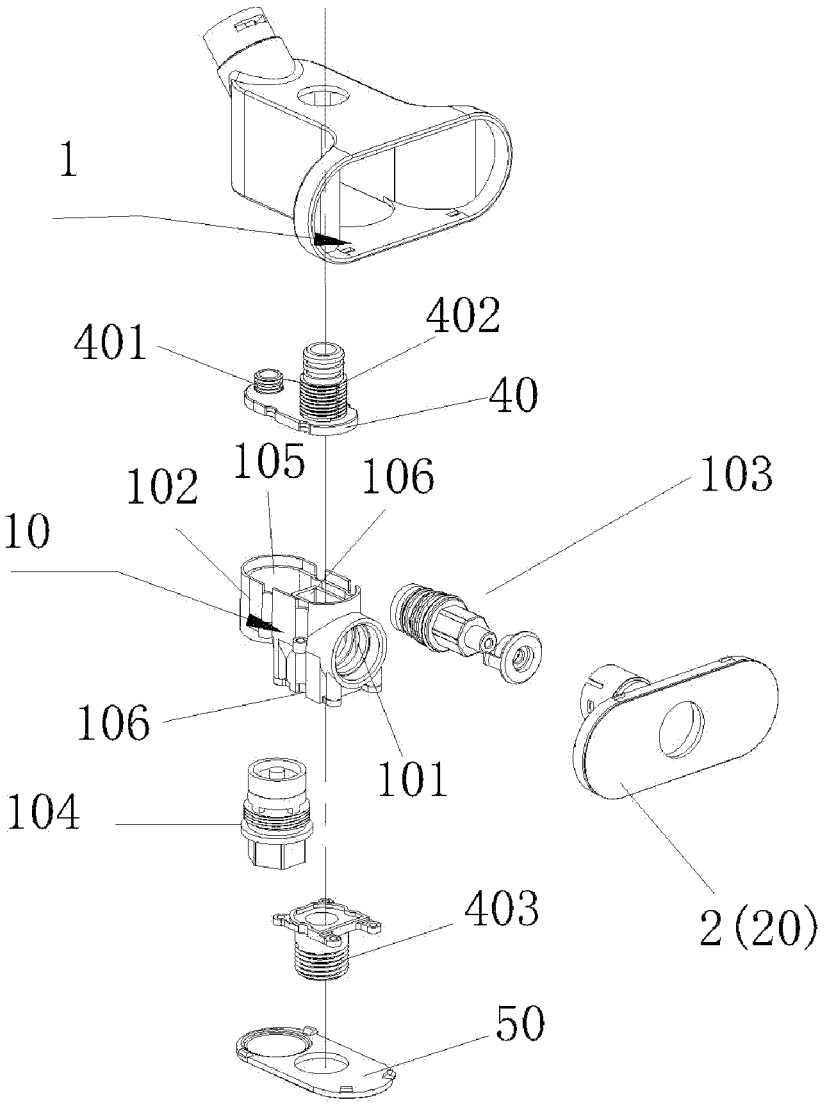
FIG. 1 is an exploded view illustrating a structure of an outlet water switching device with temperature display according to an embodiment of the present disclosure.

In order to make the present disclosure clearer, the embodiments of the present disclosure will be clearly and fully described in combination with accompanying drawings in the embodiments of the present disclosure. Apparently, the described embodiments are merely some embodiments of the present disclosure rather than all embodiments. All other embodiments obtained by those skilled in the art based on the embodiments of the present disclosure without making creative effort shall all fall within the scope of protection of the present disclosure. Therefore, the following detailed descriptions of the embodiments of the present disclosure provided in the accompanying drawings are not meant to limit the scope of protection of the present disclosure, but only represent some preferred embodiments of the present disclosure. All other embodiments obtained by those skilled in the art based on the embodiments of the present disclosure without making creative effort shall all fall within the scope of protection of the present disclosure.

In the descriptions of the present disclosure, it is noted that, the orientations or positional relationship indicated by the terms "upper", "lower", "inner", "outer", "front", "rear", "both ends", "one end", "the other end", "one surface" and "the other surface" and the like are based on orientations or positional relationship shown in the drawings and are only used for ease of descriptions and simplification of descriptions, rather than indicating or implying that an apparatus or element must have a specific orientation or constructed or operated in a specific orientation. Therefore, the above orientations or positional relationship shall not be understood as limiting of the present disclosure. Furthermore, the terms "first" and "second" are used for the purpose of description only and shall not be understood as indicating or implying relative importance.

In the descriptions of the present disclosure, it is noted that, unless otherwise stated clearly, the terms "dispose" and "connect" etc. should be understood in a broad sense, for example, the "connect" may be a fixed connection, or a detachable connection or an integral connection, or a mechanical connection, or an electrical connection or a direct connection or an indirect connection through an intermediate medium, or an internal communication between two elements. Persons of ordinary skill in the art may understand the specific meanings of the above terms in the present disclosure according to specific situations.

The present disclosure is described below in combination with specific embodiments.

Figure 2:
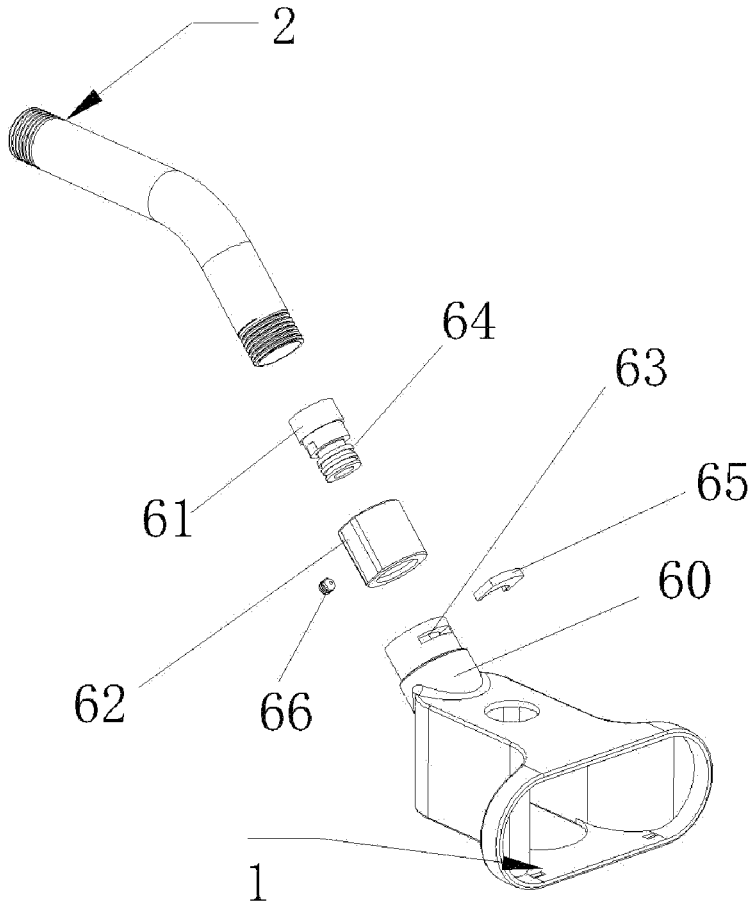
FIG. 2 is an exploded view illustrating an inlet water connection structure of an outlet water switching device with temperature display according to an embodiment of the present disclosure.
Figure 3:
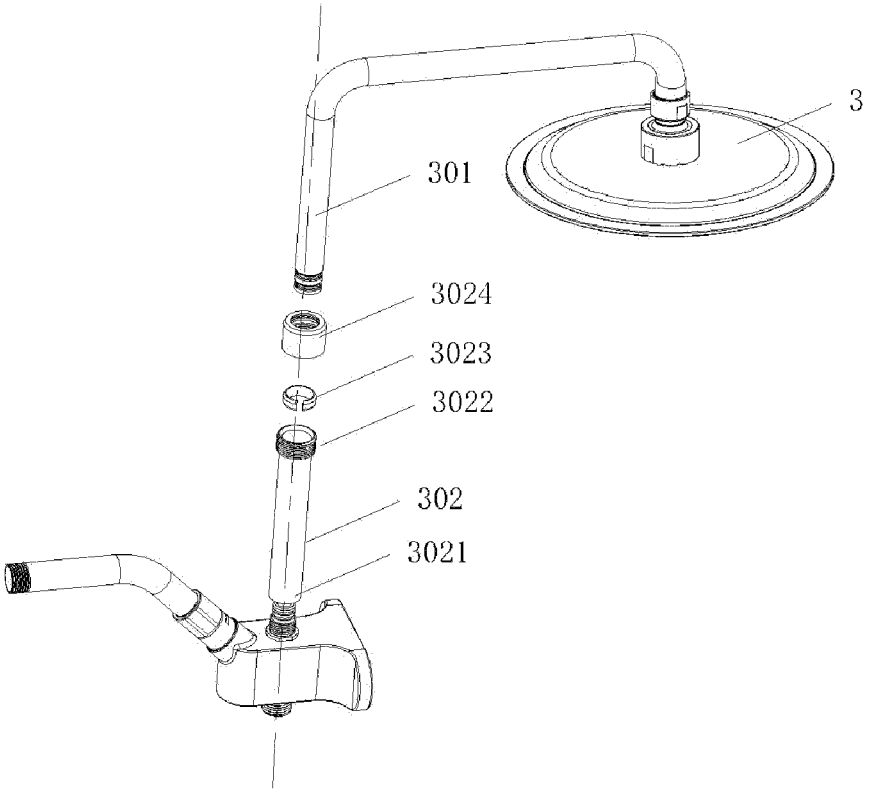
FIG. 3 is an exploded view illustrating a top water delivery height adjustment structure of an outlet water switching device with temperature display according to an embodiment of the present disclosure.
Figure 4:
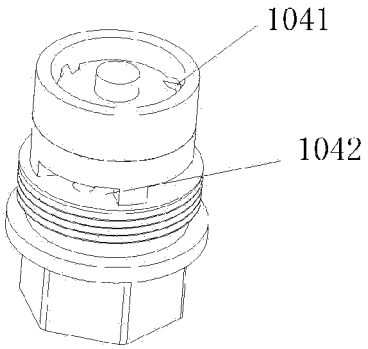
FIG. 4 is a structural schematic diagram illustrating a hydraulic power generating device of an outlet water switching device with temperature display according to an embodiment of the present disclosure.
Figure 5:
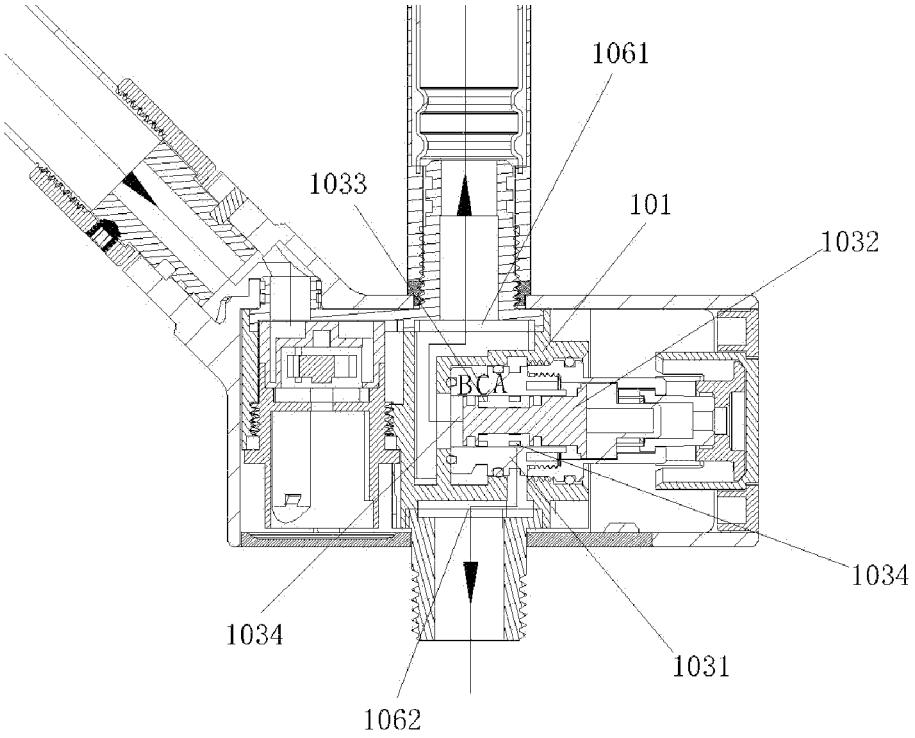
FIG. 5 is a side sectional view illustrating an outlet water switching device with temperature display according to an embodiment of the present disclosure.
Figure 6:
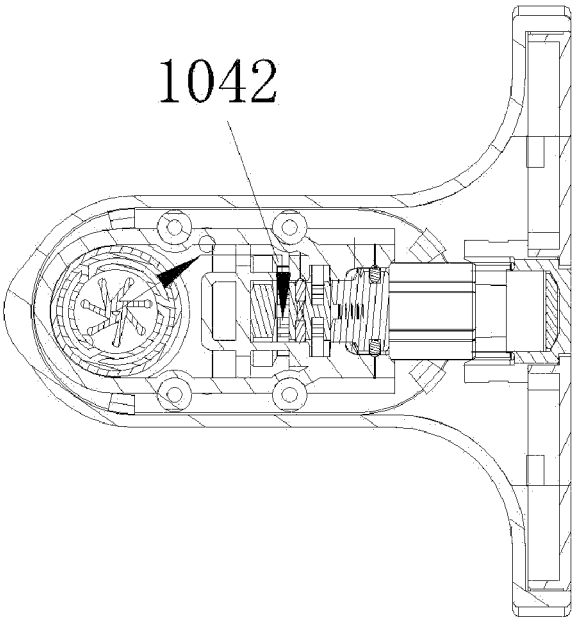
FIG. 6 is a top sectional view illustrating an outlet water switching device with temperature display according to an embodiment of the present disclosure.
Figure 7:
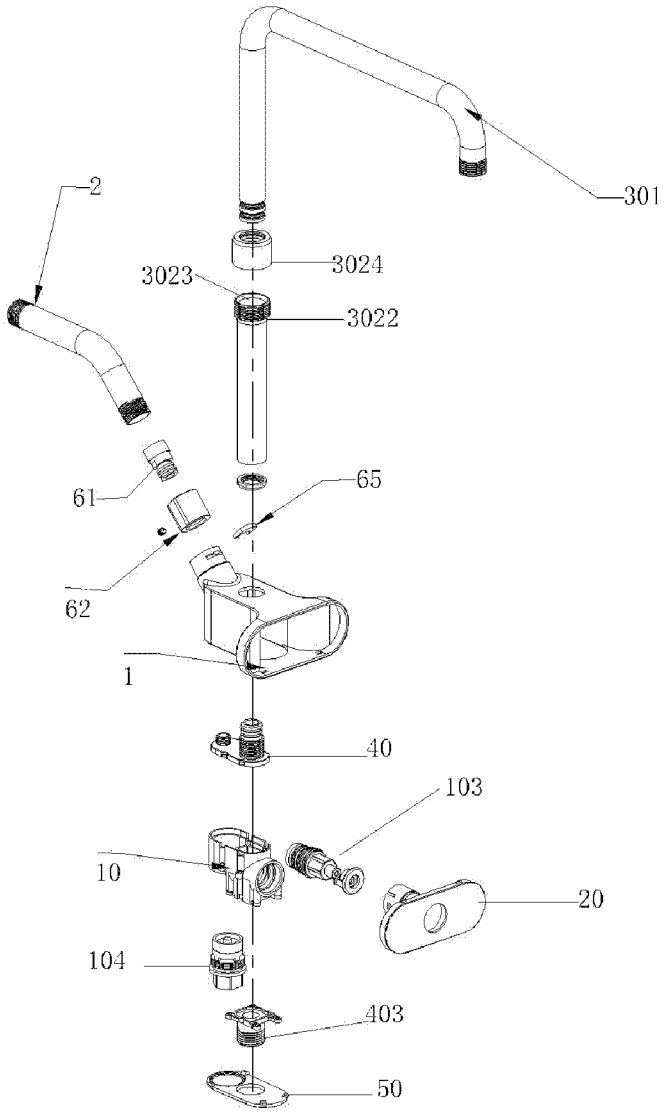
FIG. 7 is an exploded view illustrating an entire structure of an outlet water switching device with temperature display according to an embodiment of the present disclosure.
Figure 8:
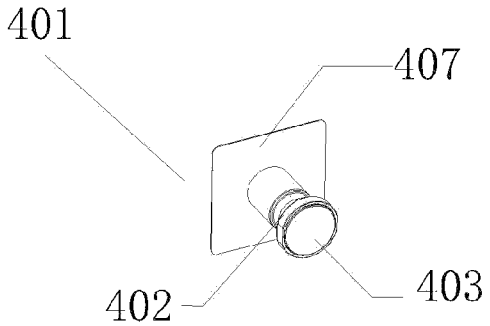
FIGS. 8-10 show three different fixing manners of a sprinkler head fixing seat of a shower system according to an embodiment of the present disclosure.
Figure 9:
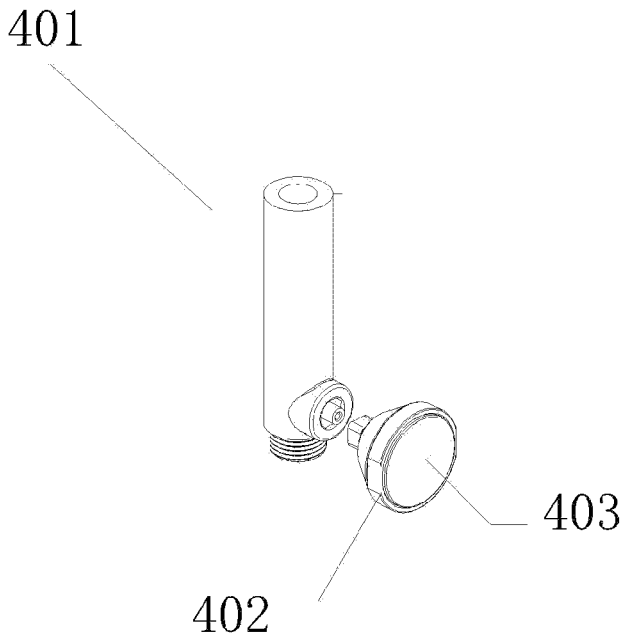
Figure 10:
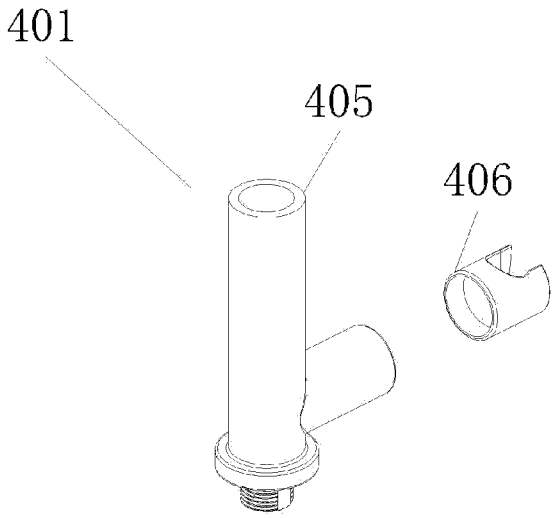

With reference to FIGS. 1-7, according to one aspect of the present disclosure, there is provided an outlet water switching device with a temperature display, which is applied to an shower system with an upward water-feeding. The system includes: a body 1, wherein the body 1 includes an inner body 10; and the inner body comprises a valve seat 101 and a water guide chamber 102; a switching valve assembly 103 and a hydraulic power generating device 104 are disposed in the inner body 10 to be in mutual communication with the valve sear 101 and the water guide chamber 102. An inlet water opening 105 and at least one outlet water opening 106 are further disposed on the inner body 10. The inlet water opening 105 is in communication with the water guide chamber 102, and the outlet water openings are in communication with the valve seat 101. A hydraulic power generating device 104 is disposed in the water guide chamber 102 to use impact force from the water flow to generate power automatically and then the water flow passes through an inlet water hole 107 on a sidewall of the valve seat into the valve seat 101. The switching valve assembly 103 selectively opens a water channel between each of the outlet water openings 106 and the inlet water hole 107. The outlet water switching device further includes a display assembly 2. The display assembly 2 includes a temperature detection element (not shown) and a display unit 20 disposed at a side of the body, wherein the temperature detection element and the display unit 20 are in electrical connection with the hydraulic power generating device 104. In some embodiments, the hydraulic power generating device 104 is provided with a plurality of inlet water holes 1041 and outlet water holes 1042. Water flow enters the inlet water holes 1041 to impact an impeller with the impact force from the water flow and then drive the power generator to generate power through the impeller, and then water flow goes out of the outlet water holes 1042. A first flow-through section of each inlet water hole 1041 is smaller than a horizontal cross section of the inlet water opening 105 (a second flow-through section), and smaller than a third flow-through section of each outlet water hole 1042. Further, a ratio of the first flow-through section to the second flow-through section to the third flow-through section may be 1:10-100:1.01-10. When the fluid passes through a reduced flow-through section, a Venturi phenomenon of increased flow rate will occur, thus increasing the rotation speed of the impeller and improving the power generation efficiency.

In some embodiments, the switching valve assembly 103 includes a water-through body 1031 sealingly disposed inside the valve seat 101 and a valve core rod 1032 slidably disposed inside the water-through body 1031. A first water hole 1033 opposed in position to the inlet water hole 1042 and a second water hole 1034 in corresponding communication with the outlet water opening 105 are disposed on the water-through body 1031. The valve core rod 1032 is enabled to perform reciprocal movement between different positions inside the water-through body 1031 under an acting force applied to an end of the valve core rod 1032, so as to selectively open the water channel between the first water hole 1033 and each second water hole 1034.

In some embodiments, the outlet water opening 106 includes a first outlet water opening 1061 and a second outlet water opening 1062 disposed reversely. Two second water holes 1034 are correspondingly disposed on the water-through body 1031. The first water hole 1033 is located between the two second water holes 1034. A water channel between the first water hole 1033 and the second water hole 1034 in communication with the first outlet water opening 1061 is opened when the valve core rod 1032 is located at a first position A. A water channel between the first water hole 1033 and the second water hole 1034 in communication with the second outlet water opening 1062 is opened when the valve core rod 1032 is located at a second position B. The first water hole 1033 is blocked when the valve core rod 1032 is located at a third position C. Specifically, the valve core rod 1032 may perform reciprocal movement between different positions under a pressing force applied to an end of the valve cord rod 1032. Namely, a valve core is a press-type valve core. The button of the valve core may be disposed in a middle portion of a display screen and formed integrally with the display screen. The switching valve assembly is further internally provided with a position sensor to detect a current water delivery state and display it on the display screen, such that a user can visually know about the current water delivery state and avoid being sprayed wet or scalded due to input mistakes.

In some embodiments, the inlet water opening 105 and the first outlet water opening 1061 are communicated with a first connector 401 and a second connector 402 respectively. The first connector 401 and the second connector 402 are both disposed on an upper surface of a first cover 40. The first cover 40 is fixedly connected to an upper side of the inner body 10. The second outlet water opening is in communication with a third connector 403. The third connector 403 may be a connection nut fixed at a lower side of the inner body 10. The lower side of the inner body 10 is further provided with a second cover 50 detachably connected to the inner body 10. The second cover 50 is provided with an opening for mounting the connection nut and the hydraulic power generating device 104. The detachable second cover 50 facilitates repair and replacement of the hydraulic power generating device 104. In some embodiments, the hydraulic power generating device 104 may be connected to the temperature detection element disposed inside or outside the body 1. The temperature detection element may be a temperature sensor of various specifications used to realize measurement of water temperature or ambient temperature, and the measured temperature is displayed on the display unit 20. Specifically, the display unit 20 may be a digital display screen such as LED or LCD or the like. It may be understood that, by use of the measured and displayed temperature, the user can adjust the water temperature adaptively to reach a most comfortable shower state.

In some embodiments, an inlet water mounting portion 60 is further disposed on the body 1. An inlet water connection rod 61 with adjustable position is fixedly clamped inside the inlet water mounting portion 60. An end of a self-spin nut 62 is sleeved around the inlet water connection rod 61 and the other end of the self-spin nut is thread-connected to an inlet water support arm 2. In some embodiments, an insertion groove 63 is opened at a sidewall of the inlet water mounting portion 60. An end of the inlet water connection rod 61 is docked with an outlet water opening of the inlet water support arm 2. A plurality of annular fitting grooves 64 sequentially arranged in a spacing are disposed on an outer wall of the other end of the inlet water connection rod 61. A fitting ring 65 is inserted into the insertion groove 63 and fitted with the annular fitting groove 64. Through connection of the inlet water connection rod 61 and the inlet water mounting portion 60, the fitting ring 65 may, at the time of being inserted into the insertion groove 63, be fitted into the annular fitting groove of the inlet water connection rod 61, so as to achieve connection of the body 1, the inlet water connection rod 61 and the self-spin nut 62, and direction fixing between the connection rod 61 and the body 1. By use of a setting screw 66, a direction between the self-spin nut 62 and the inlet water connection rod 61 is fixed such that the self-spin nut 62 can also fix the direction of the entire system. Further, a plurality of fitting grooves are disposed on the inlet water connection rod 61. During mounting, a fixing position by which the fitting ring is fitted into the fitting groove can be flexibly adjusted according to actual situations, thus providing error allowance for the mounting and increasing the mounting efficiency.

Figure 11:
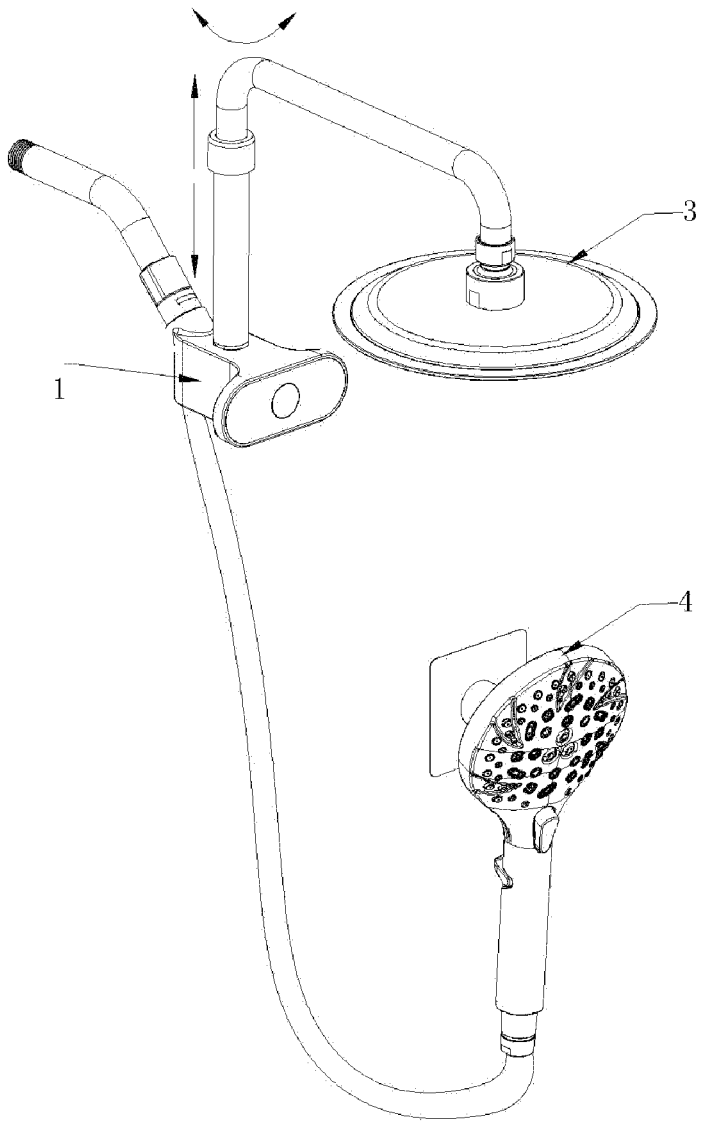
FIG. 11 is a schematic diagram illustrating an entire structure of a shower system according to an embodiment of the present disclosure.
Figure 12:
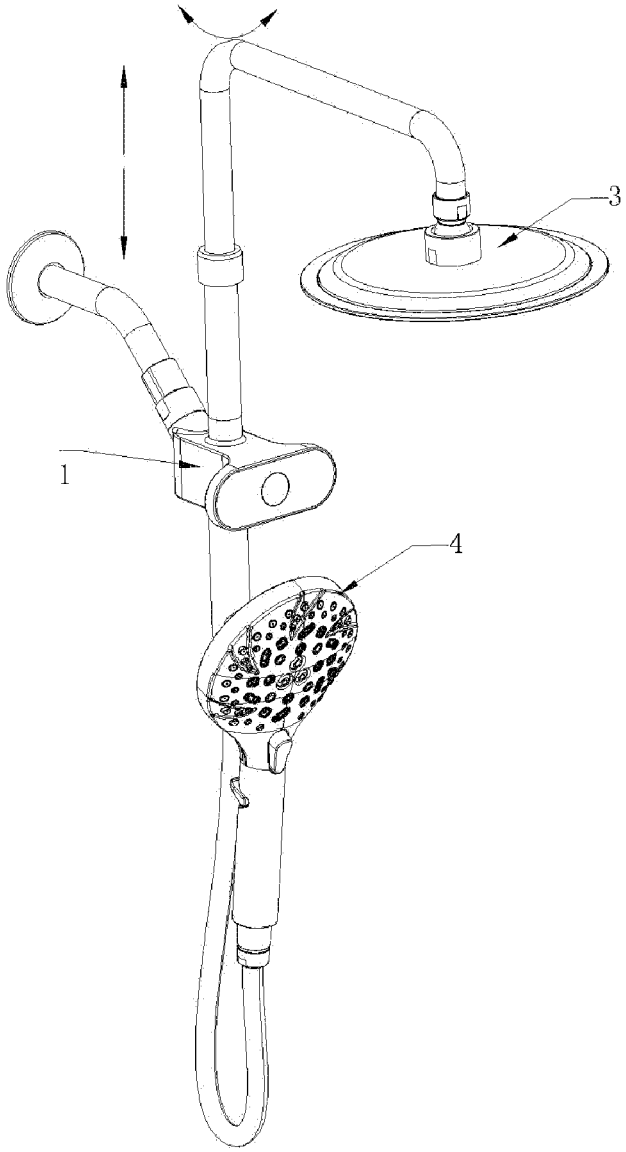
FIG. 12 is a schematic diagram illustrating an entire structure of a shower system according to another embodiment of the present disclosure.
Figure 13:
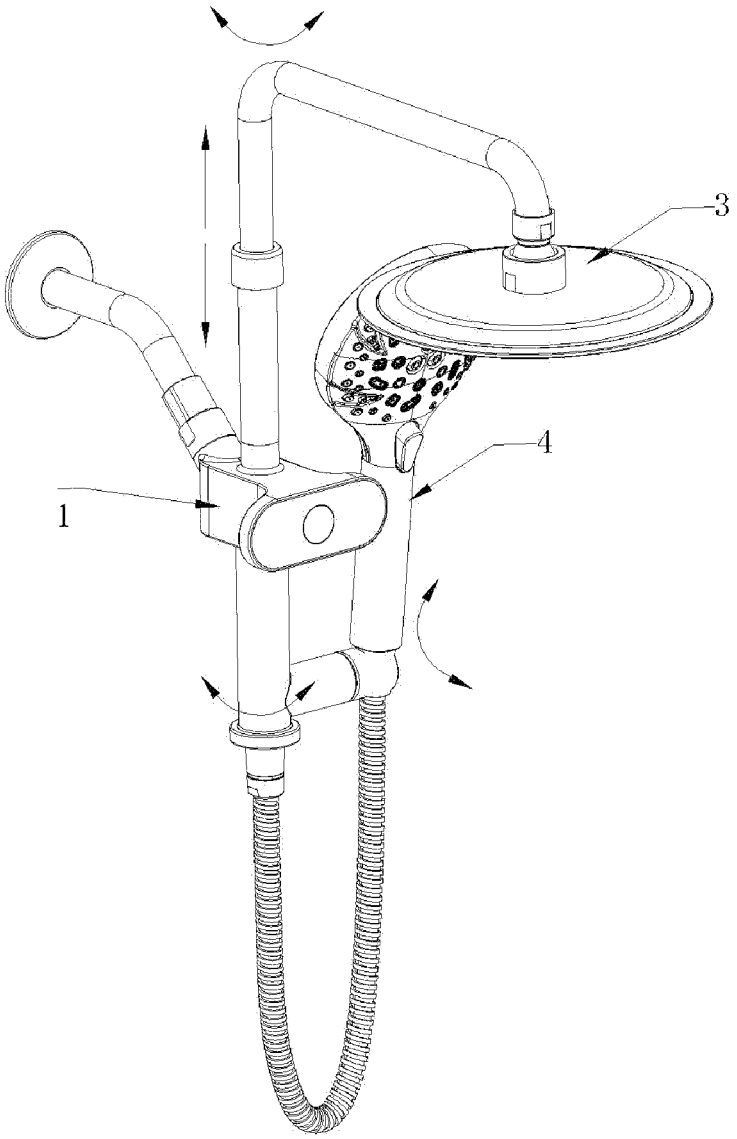
FIG. 13 is a schematic diagram illustrating an entire structure of a shower system according to yet another embodiment of the present disclosure.

With reference to FIGS. 3, 7, and 11-13, according to another aspect of the present disclosure, there is provided a shower system. The shower system includes the outlet water switching device with temperature display as described above, and further includes: a water spray shower head 3 and a pipe communicating the water spray shower head 3 with one of the outlet water openings. The pipe includes a water conveying pipe 301 connected between the water spray shower head 3 and the corresponding outlet water opening and an adjusting pipe 302 sleeved around the water conveying pipe 301. The water conveying pipe 301 is movable up and down or rotatable left and right relative to the adjusting pipe 302.

In some embodiments, a first end 3021 of the adjusting pipe 302 is sealingly connected with a corresponding outlet water opening, and a second end 3022 of the adjusting pipe 302 is provided with an external thread. A tightening ring 3023 with a gap adjustable in size is sleeved inside the second end 3022 corresponding to the external thread. An adjustable nut 3024 is sleeved around the second end 3022. When the adjustable nut 3024 is screwed down with the external thread, the tightening ring 3023 embraces the water conveying pipe 301 to fix the water conveying pipe 301. When the adjustable nut 3024 is loosened, the tightening ring 3023 releases the water conveying pipe 301 so as to adjust a height of the water conveying pipe 301 up and down, or an angle of the water conveying pipe 301 left and right. The tightening ring 3023 may be a metal ring with a movable gap opened at a sidewall, or an elastic rubber ring or the like.

With reference to FIGS. 3, 7, and 11-13, according to yet another aspect of the present disclosure, there is provided a shower system. The shower system includes the outlet water switching device with temperature display as described above, and further includes: a sprinkler head 4, a pipe communicating the sprinkler head 4 with one of the outlet water openings, and a fixing seat 401 for fixing the sprinkler head.

In some embodiments, the fixing seat 401 has a rotary head 402 capable of rotating in multiple directions and a first magnetic surface 403 disposed on the rotary head 402. A second magnetic surface 404 which is opposite in magnetism to the first magnetic surface 403 and capable of being attracted to the first magnetic surface 403 is disposed on the sprinkler head 4. The fixing seat 401 is mounted on the pipe communicating the sprinkler head with the outlet water opening or on a wall surface by a sticking sheet 407. Specifically, a ball head may be fixed on the pipe or the wall surface, and the rotary head 402 may be rotatably connected to the ball head. A recess matched in size with the first magnetic surface 403 may be opened on a back surface opposed to a water spraying surface of the sprinkler head 4, so as to magnetically fix the sprinkler head 4 to the first magnetic surface 403 through the second magnetic surface 404.

In some embodiments, the pipe communicating the sprinkler head 4 with one of the outlet water openings includes a connection pipe 405 and a water conveying hose. The connection pipe 405 is connected between the outlet water opening and the water conveying hose and rotatable left and right relative to the outlet water opening. A sprinkler head insertion seat 406 rotatable up and down relative to the connection pipe 405 is disposed on a sidewall of the connection pipe 405.

The technical aspects of the above embodiments may be further combined or replaced, and the above descriptions are used only to describe the preferred embodiments of the present disclosure, rather than limit the idea and scope of the present disclosure. Various changes and improvements made to the technical aspects of the present disclosure by those skilled in the art without departing from the design idea of the present disclosure shall fall within the scope of protection of the present disclosure.

What is claimed is:

1. An outlet water switching device comprising:

a body, wherein the body comprises an inner body; and the inner body comprise a valve seat and a water guide chamber; a switching valve assembly and a hydraulic power generating device are disposed in the inner body to be in mutual communication with the valve seat and the water guide chamber; an inlet water opening and at least one outlet water opening are further disposed on the inner body; the inlet water opening is in communication with the water guide chamber, the outlet water openings are in communication with the valve seat, respectively; the hydraulic power generating device is disposed in the water guide chamber to use impact force from a water flow to enable the hydraulic power generating device to autonomously generate power and then the water flow passes through an inlet water hole on a sidewall of the valve seat into the valve seat, and the switching valve assembly selectively opens a water channel between each of the outlet water openings and the inlet water hole;

a display assembly, comprising a temperature detection element and a display unit disposed at a side of the body, wherein the temperature detection element and the display unit are in electrical connection with the hydraulic power generating device;

wherein the switching valve assembly comprises (1) a water-through body sealingly disposed inside the valve seat and (2) a valve core rod slidably disposed inside the water-through body; a first water hole opposed in position to the inlet water hole and a second water hole in corresponding communication with the outlet water opening are disposed on the water-through body, and the valve core rod is enabled to perform reciprocal movement between different positions inside the water-through body under an acting force applied to an end of the valve core rod, so as to selectively open the water channel between the first water hole and each second water hole; and the outlet water opening comprises a first outlet water opening and a second outlet water opening disposed reversely; two second water holes of the first outlet water opening and the second outlet water opening are correspondingly disposed on the water-through body; the first water hole is located between the two second water holes; a water channel between the first water hole and the second water hole in communication with the first outlet water opening is opened when the valve core rod is located at a first position; a water channel between the first water hole and the second water hole in communication with the second outlet water opening is opened when the valve core rod is located at a second position, and the first water hole is blocked when the valve core rod is located at a third position.

2. The outlet water switching device of claim 1, wherein an inlet water mounting portion is further disposed on the body; an inlet water connection rod with adjustable position is fixedly clamped inside the inlet water mounting portion; an end of a self-spin nut is sleeved around the inlet water connection rod and the other end of the self-spin nut is thread-connected to an inlet water support arm.

3. The outlet water switching device of claim 2, wherein an insertion groove is opened at a sidewall of the inlet water mounting portion; an end of the inlet water connection rod is docked with an outlet water opening of the inlet water support arm; a plurality of annular fitting grooves sequentially arranged in a spacing are disposed on an outer wall of the other end of the inlet water connection rod; and a fitting ring is inserted into the insertion groove and fitted with the annular fitting groove.

4. A shower system, comprising the outlet water switching device with temperature display according to claim 1, and further comprising: a water spray shower head and a pipe communicating the water spray shower head with one of the outlet water openings, wherein the pipe comprises a water conveying pipe connected between the water spray shower head and the corresponding outlet water opening and an adjusting pipe sleeved around the water conveying pipe, and the water conveying pipe is movable up and down or rotatable left and right relative to the adjusting pipe.

5. The shower system of claim 4, wherein, a first port of the adjusting pipe is sealingly connected with a corresponding outlet water opening; a second port of the adjusting pipe is provided with an external thread; a tightening ring with a gap adjustable in size is sleeved inside the second port corresponding to the external thread; and an adjustable nut is sleeved around the second port; when the adjustable nut is screwed down with the external thread, the tightening ring embraces the water conveying pipe to fix the water conveying pipe; and when the adjustable nut is loosened, the tightening ring releases the water conveying pipe so as to adjust a height of the water conveying pipe up and down.

6. The shower system, comprising the outlet water switching device with temperature display according to claim 1, and further comprising a sprinkler head, a pipe communicating the sprinkler head with one of the outlet water openings and a fixing seat for fixing the sprinkler head.

7. The shower system of claim 6, wherein; the fixing seat has a rotary head capable of rotating in multiple directions and a first magnetic surface disposed on the rotary head, a second magnetic surface which is opposite in magnetism to the first magnetic surface and capable of being attracted to the first magnetic surface is disposed on the sprinkler head, and the fixing seat is mounted on the pipe communicating the sprinkler head with the outlet water opening or a wall surface.

8. The shower system of claim 6, wherein, the pipe communicating the sprinkler head with one of the outlet water openings comprises a connection pipe and a water conveying hose, the connection pipe is connected between the outlet water opening and the water conveying hose and rotatable left and right relative to the outlet water opening, and a sprinkler head insertion seat rotatable up and down relative to the connection pipe is disposed on a sidewall of the connection pipe.

9. The shower system, comprising the outlet water switching device with temperature display according to claim 1, wherein, the outlet water opening comprises the first outlet water opening and the second outlet water opening disposed reversely; two second water holes are correspondingly disposed on the water-through body; the first water hole is located between the two second water holes; the water channel between the first water hole and the second water hole in communication with the first outlet water opening is opened when the valve core rod is located at the first position; the water channel between the first water hole and the second water hole in communication with the second outlet water opening is opened when the valve core rod is located at the second position, and the first water hole is blocked when the valve core rod is located at the third position.

10. The shower system, comprising the outlet water switching device with temperature display according to claim 9, wherein; the switching valve assembly comprises the water-through body sealingly disposed inside the valve seat and the valve core rod slidably disposed inside the water-through body, the first water hole opposed in position to the inlet water hole and a second water hole in corresponding communication with the outlet water opening are disposed on the water-through body; and the valve core rod is enabled to perform reciprocal movement between different positions inside the water-through body under an acting force applied to an end of the valve core rod, so as to selectively open the water channel between the first water hole and each second water hole.

11. The shower system, comprising the outlet water switching device with temperature display according to claim 10, wherein; the outlet water opening comprises the first outlet water opening and the second outlet water opening disposed reversely; two second water holes are correspondingly disposed on the water-through body; the first water hole is located between the two second water holes; the water channel between the first water hole and the second water hole in communication with the first outlet water opening is opened when the valve core rod is located at the first position; the water channel between the first water hole and the second water hole in communication with the second outlet water opening is opened when the valve core rod is located at the second position; and the first water hole is blocked when the valve core rod is located at the third position.

12. The shower system, comprising the outlet water switching device with temperature display according to claim 9, wherein; the inlet water mounting portion is further disposed on the body; the inlet water connection rod with adjustable position is fixedly clamped inside the inlet water mounting portion; the end of the self-spin nut is sleeved around the inlet water connection rod and the other end of the self-spin nut is thread-connected to the inlet water support arm.

13. The shower system, comprising the outlet water switching device with temperature display according to claim 12, wherein, an insertion groove is opened at a sidewall of the inlet water mounting portion; an end of the inlet water connection rod is docked with an outlet water opening of the inlet water support arm; a plurality of annular fitting grooves sequentially arranged in a spacing are disposed on an outer wall of the other end of the inlet water connection rod; and a fitting ring is inserted into the insertion groove and fitted with the annular fitting groove.

14. The shower system, comprising the outlet water switching device with temperature display according to claim 1, further comprising a sprinkler head, a pipe communicating the sprinkler head with one of the outlet water openings and a fixing seat for fixing the sprinkler head.

15. The shower system, comprising the outlet water switching device with temperature display according to claim 1, wherein, the outlet water opening comprises a first outlet water opening and a second outlet water opening disposed reversely; two second water holes are correspondingly disposed on the water-through body, the first water hole is located between the two second water holes; a water channel between the first water hole and the second water hole in communication with the first outlet water opening is opened when the valve core rod is located at a first position; a water channel between the first water hole and the second water hole in communication with the second outlet water opening is opened when the valve core rod is located at a second position; and the first water hole is blocked when the valve core rod is located at a third position.

16. The shower system, comprising the outlet water switching device with temperature display according to claim 2, wherein an inlet water mounting portion is further disposed on the body; an inlet water connection rod with adjustable position is fixedly clamped inside the inlet water mounting portion; an end of a self-spin nut is sleeved around the inlet water connection rod and the other end of the self-spin nut is thread-connected to an inlet water support arm.

17. The shower system, comprising the outlet water switching device with temperature display according to claim 3, wherein, an insertion groove is opened at a sidewall of the inlet water mounting portion; an end of the inlet water connection rod is docked with an outlet water opening of the inlet water support arm; a plurality of annular fitting grooves sequentially arranged in a spacing are disposed on an outer wall of the other end of the inlet water connection rod; a fitting ring is inserted into the insertion groove and fitted with the annular fitting groove.

* * * * *